United States Patent [19]

Windelbandt

[11] Patent Number: 4,926,534

[45] Date of Patent: May 22, 1990

[54] METHOD FOR MANUFACTURING A POPPET VALVE HEAD

[75] Inventor: Herbert Windelbandt, Aachen, Fed. Rep. of Germany

[73] Assignee: Sempell Armaturen GmbH, Fed. Rep. of Germany

[21] Appl. No.: 349,919

[22] Filed: May 9, 1989

Related U.S. Application Data

[63] Continuation of Ser. No. 155,121, Feb. 10, 1988, abandoned.

[30] Foreign Application Priority Data

Feb. 17, 1987 [DE] Fed. Rep. of Germany ..... 3704948
Jul. 14, 1987 [EP] European Pat. Off. ..... 87110122.6

[51] Int. Cl.[5] ..... B21K 1/22

[52] U.S. Cl. ..... 29/888.451; 29/888.452; 72/354

[58] Field of Search ..... 29/157.1 R, 156.7 R, 29/421, 400 D

[56] References Cited

U.S. PATENT DOCUMENTS 1,644,021 10/1927 Knudsen ..... 29/156.7 R
1,696,646 12/1928 Saives ..... 29/156.7 R
2,138,528 11/1938 Phillipps ..... 29/156.7 R
3,319,321 5/1967 Davis ..... 29/156.7 R
3,536,053 10/1970 Uitcha ..... 29/156.7 R
3,636,605 1/1972 Uitcha et al. ..... 29/156.7 R
4,741,080 5/1988 Larson et al. ..... 29/156.7 R

*Primary Examiner*—Timothy V. Eley
*Assistant Examiner*—I. Cuda
*Attorney, Agent, or Firm*—W. G. Fasse; D. H. Kane, Jr.

[57] ABSTRACT

A poppet valve head with its stem, is formed in a female finish forming die cooperating with two male die members. A cylindrical raw blank, which has been heated is cut to length. An extrusion pressing or molding forms the shaft region and widened shaft region. An immediately following upset pressing forms the poppet disk. Both pressing steps are performed in the same female finish forming die made of hard metal mounted in a supporting frame. The female finish forming die has a cylindrical guide region on the poppet disk end. A force actuated annular or ring piston forms a first male die member fitting into the guide region. The raw blank is inserted into a central cavity of the annular piston on a coaxially arranged force actuated extrusion molding stamp forming a second male die member slidable in the central cavity. The extrusion molding stamp is axially slidable together with the annular piston and also axially slidable relative to the annular piston.

4 Claims, 5 Drawing Sheets

30
27
56
8
28
8
56
1
9
5
16
34
16
4
33
10
7
33
6
51
25
26
24
46
23
40
39
15
p3
44
15
79
45
77
39.1
p3
78
p4
15
15
p4
80
56
56
12
81
14
38
14'
p1
11
p4
13'
13
37
p2

METHOD FOR MANUFACTURING A POPPET VALVE HEAD

This application is a continuation of application Ser. No. 07/155,121filed Feb. 10, 1988, abandoned.

FIELD OF THE INVENTION

The invention relates to a method for manufacturing a poppet valve head by means of extrusion molding of the valve stem and hot deformation of the poppet disk.

DESCRIPTION OF THE PRIOR ART

In poppet valves which have the form of a so-called bi-metal, the poppet valve head has a short stem portion which is welded onto the actual valve stem. To achieve this, the valve head is manufactured from a cylindrical raw blank which has an appropriate diameter and which is cut to a length appropriate for the following deformation. The necessary short stem neck is manufactured from this cylindrical raw blank by means of extrusion molding. Then, in a separate operation, the partly machined blank with its stem neck is inserted into an upset apparatus which forms the valve disk by an upsetting of the thicker part of the blank remaining after the extrusion molding. Finally, the manufactured valve head is welded onto the valve stem at its valve stem neck, as mentioned above.

This procedure is complicated and requires several steps including costly intermediate handling, so that automation of the procedure is quite difficult.

OBJECT OF THE INVENTION

In view of the foregoing it is the aim of the invention to achieve the following objects singly or in combination:

- to achieve a simplified method of manufacturing a poppet valve head, and to easily automate such a method;
- to allow a poppet valve head to be completely finish formed in a single work cycle in a single work station, thereby eliminating handling or repositioning of work pieces;
- to provide an apparatus which carries out the method of the invention by extrusion molding and subsequently upset pressing a raw blank in the same single finish forming die means of the apparatus;
- to achieve continuous control of the pressing velocities during the pressing operations to avoid work-hardening the work pieces; and
- to efficiently use components of such an apparatus to achieve a small total number of components, compact size, and high reliability.

SUMMARY OF THE INVENTION

These objects have been achieved according to the invention in a method for manufacturing a poppet valve head, in which the valve stem is formed by extrusion molding and the poppet disk is formed by upset pressing of an appropriately sized, preheated raw blank. Specifically, a cylindrical raw blank, which has been heated and cut to length, is filled into a finish forming die by means of extrusion molding in the shaft region and the widened shaft region of the die, and by means of an immediately subsequent upset pressing in the poppet disk region of the die. Accordingly, the finish forming die, which is made of hard metal, is first used as an extrusion molding or pressing die, whereby a relocation of the partially machined raw blank is no longer required after the extrusion molding step. In this manner, not only the valve stem part, but also the widened stem region is manufactured simultaneously by means of an extrusion molding or pressing. Because the extrusion molding process is also used for the widened stem region in the finish forming die, a pre-upset head blank is formed in the poppet disk region. The pre-upset head blank may be hot deformed to a finished head by means of upset pressing in the same finish forming die. This method, for example, makes it possible to completely form the finished poppet valve head from the raw blank in a single machining station. The arrangement of a separate extrusion molding station is totally superfluous. In this case, it is advantageous that the raw blank is guided during the extrusion molding by a stamp guide bushing of an extrusion molding stamp. A special advantage arises if the upsetting velocity is controlled during the upsetting process in such a manner that the upsetting velocity always remains less than the softening velocity (softening velocity means a speed avoiding work hardening). Otherwise, a hardening of the material and therewith a very high force requirement arises through the upsetting procedure. On the other hand, the heat tends to soften the material almost immediately. Here, the softening occurs more slowly the further advanced the single upsetting process is. Thus, the softening velocity is the upsetting velocity at which the material still has sufficient time to become softened. If this upsetting velocity is not exceeded, then the force requirement for the upsetting process remains noticeably lower. It should further be noted that this upsetting velocity is reduced with increasing upsetting path distance according to an exponential function. Thus, the hydraulic streams delivered by the pumps driving the upsetting cylinders must be appropriately controlled.

An apparatus suitable for carrying out the present method comprises a single finish forming die means for the poppet valve head, arranged in a supporting frame. The finish forming die has a cylindrical guide region on the poppet disk end. The apparatus further comprises a force actuated annular piston which fits into the guide region. A raw blank is insertable into an inner chamber or cavity of the annular piston on a coaxially arranged force actuated extrusion molding stamp. The extrusion molding stamp is both axially slidable together with the annular piston as well as axially slidable relative to the latter. The inserted raw blank may now simply be transported together with the annular piston and the extrusion molding stamp into a first station in which the annular piston is immersed in the guide region of the finish forming die. Here, the immersion depth is just large enough to assure sufficient guidance of the raw blank for the extrusion molding process. Now the extrusion molding process is carried out in that the extrusion molding stamp pushes the raw blank forward until the end face of the extrusion molding stamp lies in the same plane as the end face of the annular piston so that a single closed surface is formed in this region. Then the annular piston and the extrusion molding stamp continue to move forward together in this position relative to one another in an upset pressing step. By means of this upset pressing step, the raw blank is pressed completely into the finish forming die and the poppet disk region of the finish forming die is completely filled with material. Thereby, the finished valve head is produced, and may simply be ejected from the finish forming die by the provided ejector. Furthermore, a construction of the apparatus for carrying out the method according to the invention is especially to be achieved, which makes possible a good controllability of the extrusion molding and the upset pressing processes. A further goal is the combined utilization of components already necessary for the operation of separate process stages in order to retain a low number of required components and to achieve an efficient utilization of the provided components. An example of this is the use of the stamp guide bushing of the extrusion molding stamp on the one hand as a force actuated annular piston, and on the other hand as a guide for the raw blank.

Furthermore, according to the invention, the entire apparatus is to be arranged in a manner such that, on the one hand, it is easy to repair, and on the other hand it may easily be converted to other sizes or shapes of finished products. Simultaneously, the apparatus is to be structurally self-contained, so that outer structural elements for transmitting forces become superfluous.

BRIEF DESCRIPTION OF THE DRAWINGS

In order that the invention may be clearly understood, it will now be described, by way of example, with reference to the accompanying drawings, wherein.

Figure 1:
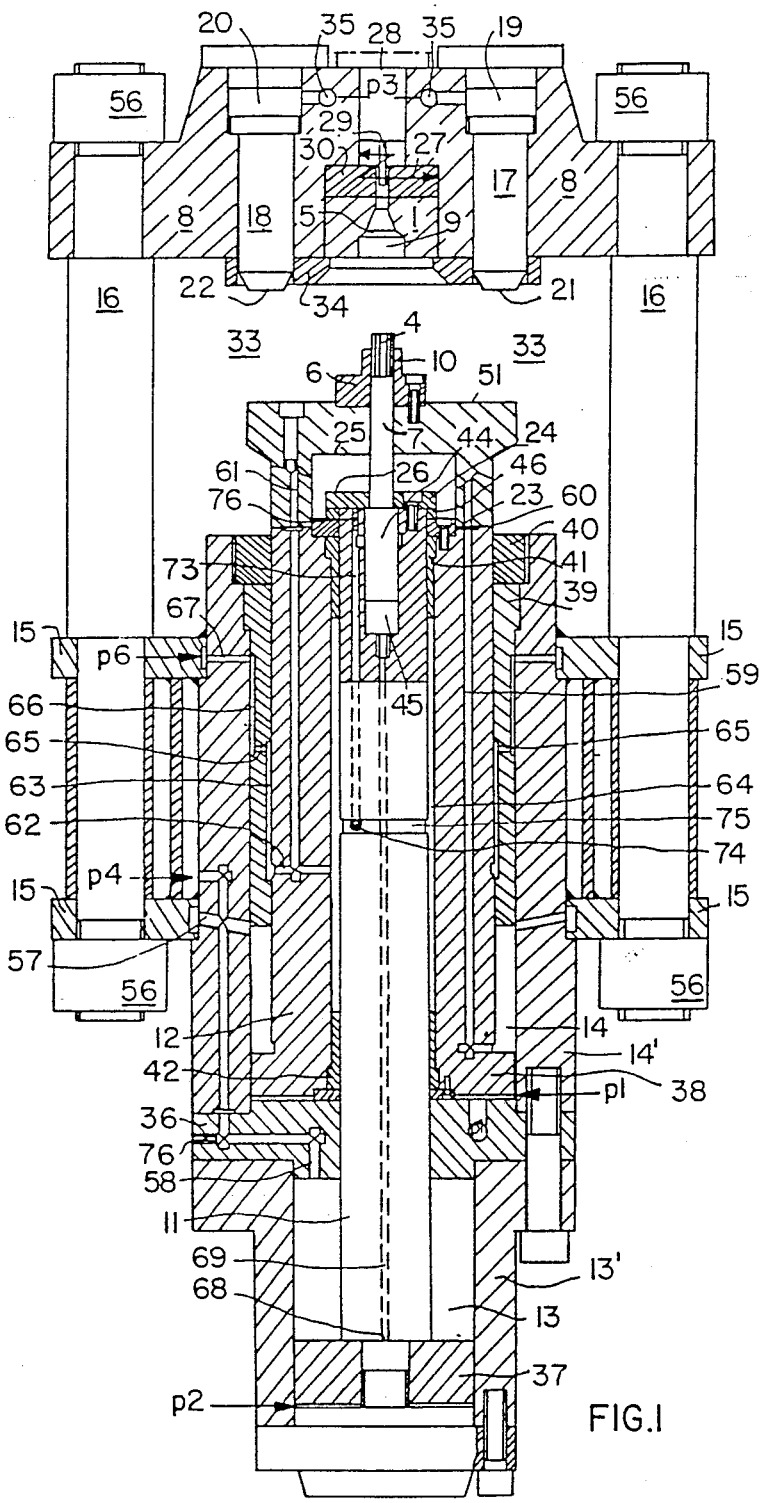
FIG. 1 is a lengthwise sectional view through the apparatus according to the invention.
Figure 3:
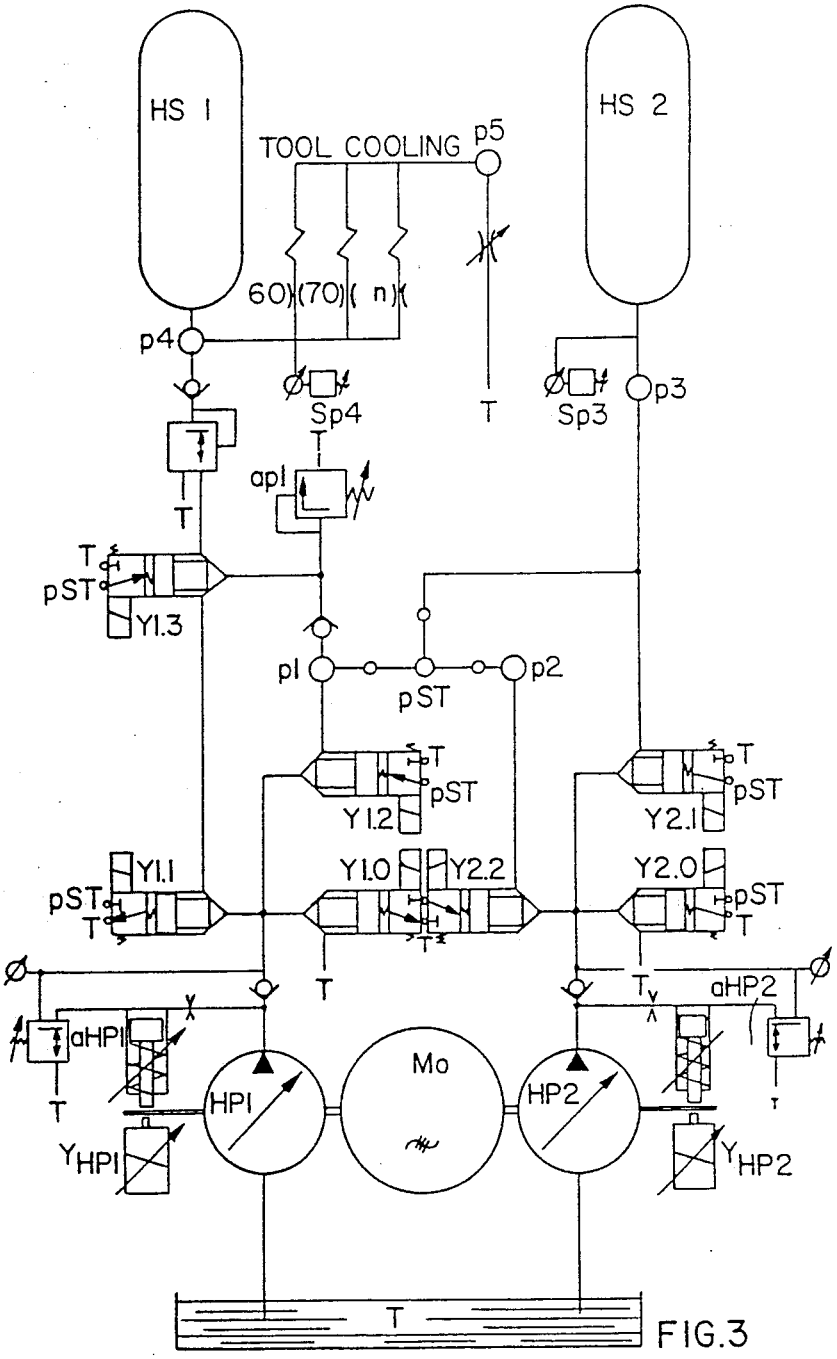
Figure 4:
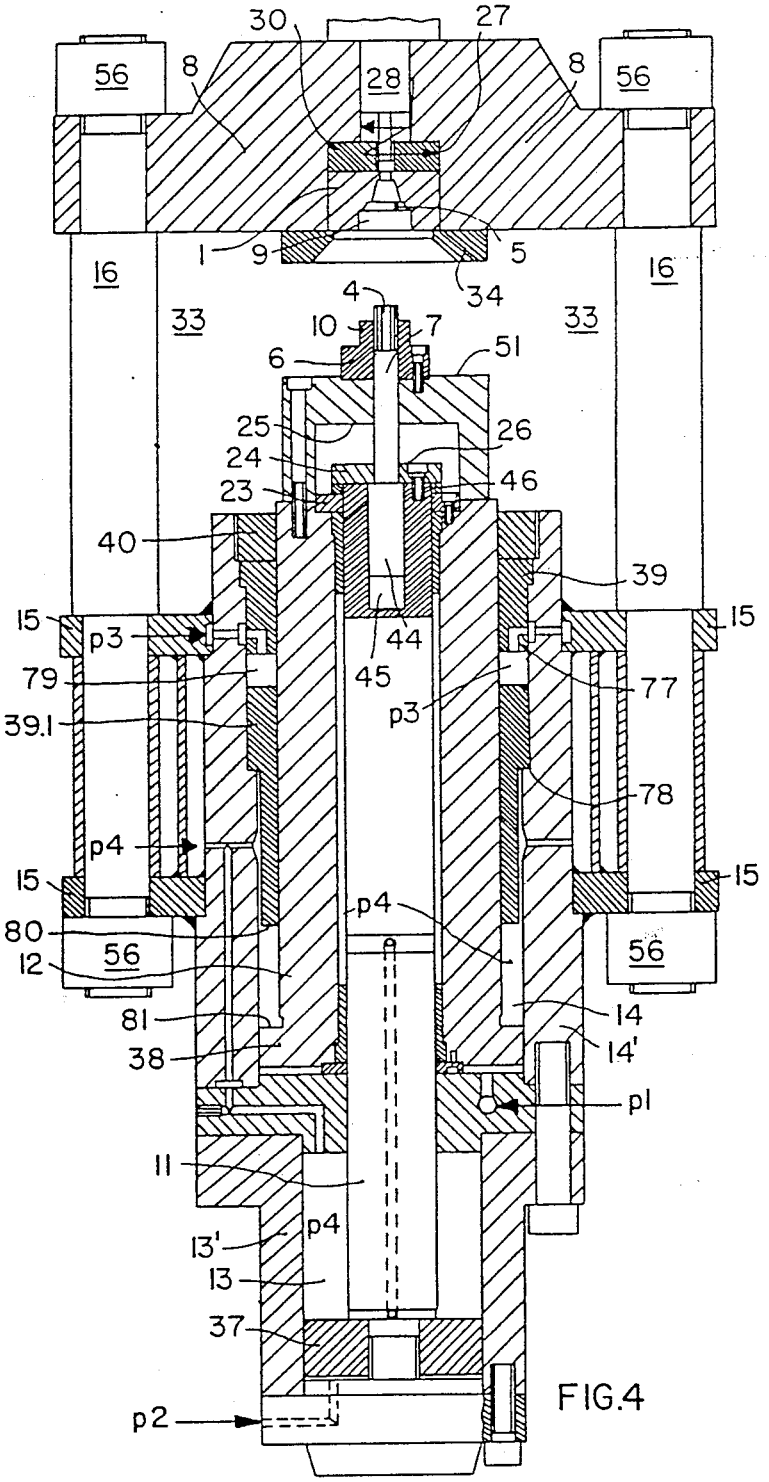

FIGS. *2a* and *2b* show an enlarged view of the working region according to FIG. 1;

FIG. 3 is a hydraulic circuit diagram;

FIG. 4 is a view as in FIG. 1, however with an inner stop.

DETAILED DESCRIPTION OF PREFERRED EXAMPLE EMBODIMENTS AND OF THE BEST MODE OF THE INVENTION

An upper locking girder or supporting frame 8, and a traverse girder 15 are arranged opposite one another and are connected to one another at a distance apart by tie rods 16. The supporting frame 8 comprises a central bored hole 27 which may have the form of a stepped bore. In the upper portion of the bored hole an ejection cylinder 28 may be arranged with an ejector 29, whereby the ejection cylinder 28 and the ejector 29 have the function of ejecting a finished work piece out of the finish forming die 1. The finish forming die 1 is arranged coaxially with the ejection cylinder 28 in the step bored hole 27 of the supporting frame 8.

As shown in FIG. *2a*, the finish forming die 1 comprises a shaft region or cavity 2 and a widened shaft region or cavity 3 as well as a poppet disk region or cavity 5 which extends into a cylindrical guide region 9. In order to adjust or fit the axial length, the finish forming die 1 may be set onto a spacer disk 30 in the central bored hole 27, and in order to fit various diameters, may be slidingly inserted into an appropriate inserted bushing 31 which may also be made of hard metal and thus forms a hard metal casing. The bushing 31 is exchangeable and serves to compensate for various diameters of the finish forming die 1 so that the finish forming die 1 is always securely and rigidly arranged coaxially in the central bored hole 27. For simplicity, the bushing 31 is not shown in FIG. 1.

The traverse girder 8 is provided with cooling channels 32 in the region of the central bored hole 27 as shown in FIG. *2a* and *2b*. Any desired cooling medium may be delivered through the cooling channels in order to remove excess heat to the extent necessary. Cooling flows are discussed further below.

The supporting frame further comprises two fluid actuated cylinders 19 and 20 with piston rods 17 and 18, arranged on both sides of the finish forming die 1 parallel to the working direction and to the axis of the finish forming die 1. The end faces 21 and 22 of the piston rods 17 and 18 protrude into the working space 33 of the apparatus, at least when the piston rods 17 and 18 are extended into an end position. In this position, the end faces 21 and 22 form a stop which limits the axial transport motion of a stamp guide bushing 6 in a first step, so as to position the stamp guide bushing 6 in a first position. A holding ring 34 may further be provided for holding or mounting the finish forming die 1. For the sake of clarity, such a holding ring 34 is not shown in FIGS. *2a* and *2b*.

As shown in FIG. 1, in order to extend the piston rods 17 and 18, the fluid actuated cylinders 19 and 20 are actuated by the pressure P3 through the pressure connections 35. If the pressure connections 35 are unloaded, then the piston rods 17 and 18 may simply be pushed in again. Here, the piston stroke of the fluid actuated cylinders 19 and 20 is of a dimension so that in the extended end position the end faces 21 and 22, which form a stop surface, are in the correct stop position.

The traverse girder 15 carries two similarly fluid driven actuating cylinders 13 and 14 in coaxial arrangement. The piston rods 11 and 12 of the cylinders 13 and 14 are correspondingly coaxially arranged with respect to one another, and are nested in one another in the manner of a telescope, whereby the piston rod 11 is the inner piston rod and the piston rod 12 is the outer piston rod. The housing 14' of the actuating cylinder 14 is here directly connected to the traverse girder 15. On the outer side facing away from the working space 33, the actuating cylinder 14 is closed by a sealing intermediate plate 36 which also serves as a sealing end cover of the housing 13' of the cylinder 13. The housing 13' has the form of a cylindrical pipe with a flange and lid, and is arranged coaxially with the housing 14', which has the form of a cylindrical pipe. In this arrangement, the piston rod 11 is connected to a piston 37 acting in the cylinder 13, and the piston rod 12 is connected to a piston 38 acting in the cylinder 14. A spacer bushing 39 is arranged coaxially relative to and enclosing the piston rod 12 in the actuating cylinder 14. The axial path of the piston 38 and therewith the length of the extension path for the piston rod 12 is limited by the spacer bushing 39, which may, however, also radially guide the piston rod 12. During the stroke motion, the piston rod 12 is radially guided on the one hand in the housing 14' by the piston 38, and on the other hand by the cover ring 40. Within the piston rod 12, the piston rod 11 is radially guided by means of the bushings 41 and 42. Here, the front end face of the bushing 41 is covered by a catch ring or entraining member secured to the piston rod 12 and encircling the piston rod 11. A ring shaped counter piece or cam 24 is attached to the front end face of the piston rod 11 and comprises an outer diameter which is larger than the diameter of the piston rod 11 so that the counter piece 24 at least partially radially overlaps the catch ring 23. Thereby, when the piston rod 12 is axially displaced in the direction of the working space 33 the catch ring 23 comes into contact with the counter piece 24 and thereafter carries the piston rod 11 along with it.

At its end face end directed toward the working space 33, the piston rod 11 comprises an axially directed bored hole 43 into which is inserted an extrusion molding stamp 7 with a widened stamp shaft portion 44. In the bored hole 43, the stamp shaft portion 44 is supported against a compensation disk 45. The exact axial position of the extrusion molding stamp 7 may be determined by means of the thickness of the compensation disk 45.

The stamp shaft portion 44, which is thicker than the diameter of the extrusion molding stamp 7, is held in the bored hole 43 by the counter piece 24 which comprises an appropriate bored hole, which is not referred to in detail, through which the guide stamp 7 passes. In order to determine the exact relative position of the piston rod 12 and the piston rod 11 in the axial direction with respect to one another, for the moment of first carrying contact of the piston rod 11 by the piston rod 12, a spacer ring 46 is additionally placed loosely on the piston rod 11 between the catch ring 23 and the counter piece or cam 24.

Figure 2A:
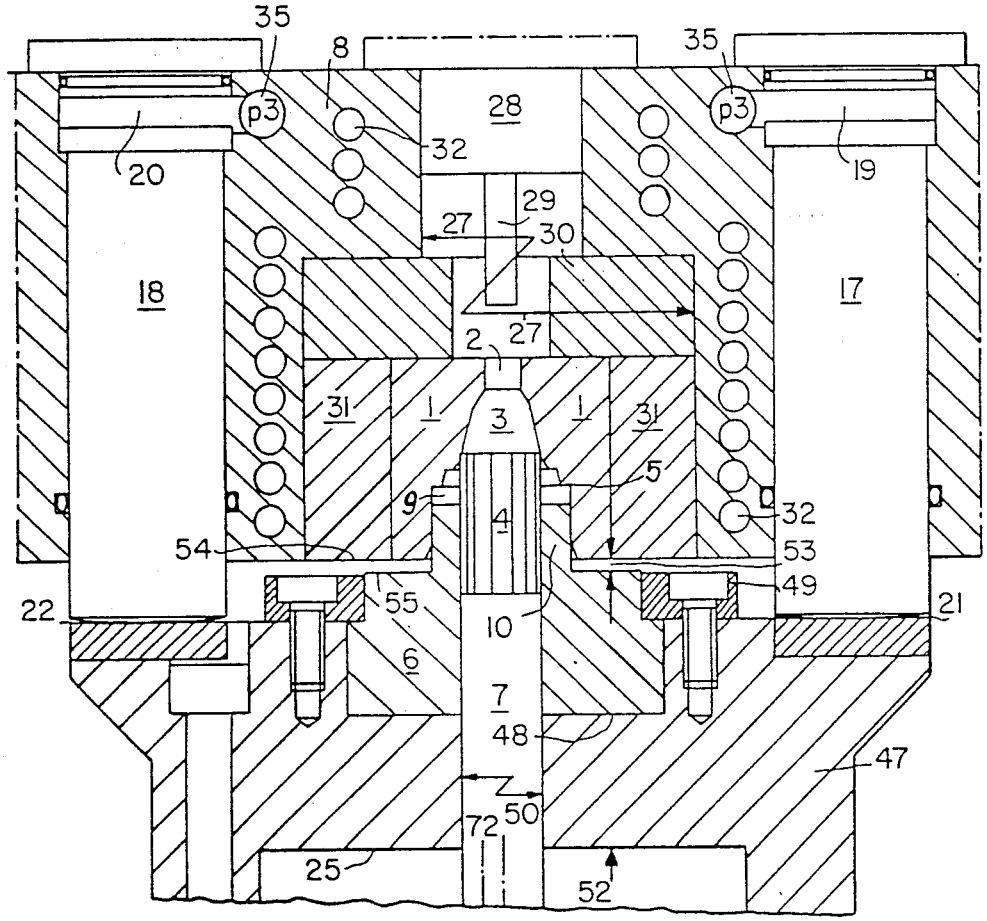
Figure 2B:
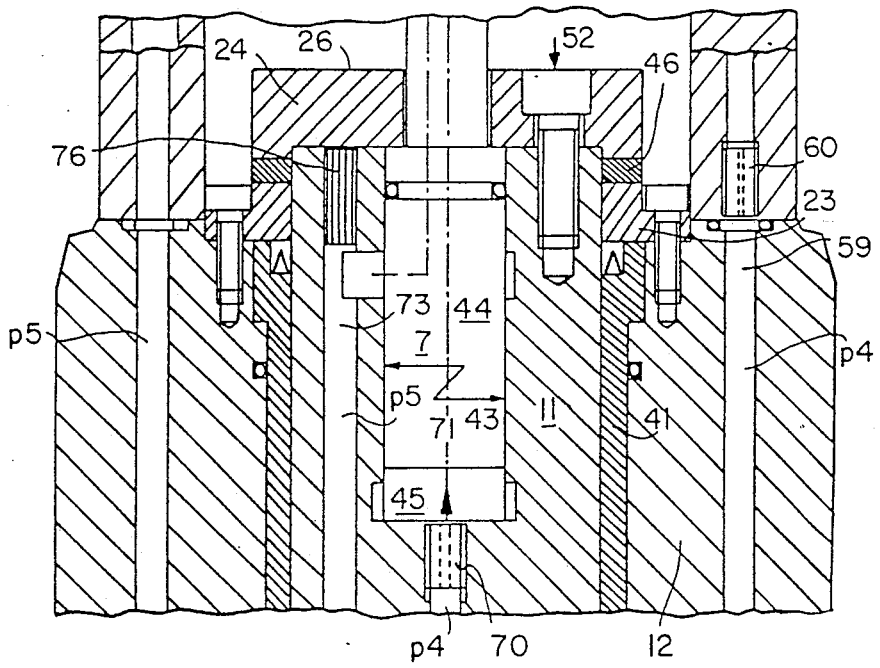

As further shown in FIGS. 2*a* and 2*b* at its end face directed toward the working space 33, the piston rod 12 comprises a carrying member 47 which carries the stamp guide bushing 6 which is set into an appropriate recess 48. The stamp guide bushing 6 may be connected to the carrying member 47 by a holding ring 49, or directly, as shown in FIG. 1. The carrying member 47 comprises a bored hole 50 for passing the extrusion molding stamp 7. The stamp guide bushing 6 also comprises an appropriate bored hole which is to guide the extrusion molding stamp 7. The stamp guide bushing 6 comprises an annular piston 10 facing the working space 33, whereby the inner bored hole of the annular piston 10 corresponds to the bored hole of the stamp guide bushing 6, which is not referenced in detail. The outer diameter of the annular piston 10 is chosen so as to fit to the diameter of the cylindrical guide region 9 of the finish forming die 1.

In order to manufacture a poppet valve head, a raw blank 4, which has already been cut to length and heated to the necessary temperature and of which the diameter corresponds to the diameter of the extrusion molding stamp 7, is set into the free space of the stamp guide bushing 6 so that it rests against the retracted extrusion molding stamp 7 and thereby protrudes somewhat beyond the end face region of the annular piston 10, as shown in FIG. 1. The pressure p3 is delivered to the pressure connections 35 so that the piston rods 17 and 18 of the fluid actuated cylinders 19 and 20 extend to their outer end position as this is shown in both FIG. 1 and FIGS. 2*a* and 2*b*. The housing 14' of the actuating cylinder 14 comprises, at its lower end, a pressure connection to which the pressure p1 of a fluid flow medium is supplied so that the piston 38 and therewith the piston rod 12 are extended. Thereby, the piston rod 11 is carried along by means of the catch ring 23 and the counter piece 24. By these means the relative position between the stamp guide bushing 6 and the extrusion molding stamp 7 arranged therein, is maintained. Through the movement of the piston rod 12, the annular piston 10 of the stamp guide bushing 6 is driven into the cylindrical guide region 9 of the finish forming die 1 to such a distance that the end face 51 comes into contact with the end faces 21 and 22 of the piston rod 17 and 18 respectively. This situation is shown in FIGS. 2*a* and 2*b*. When the components are in this position the counter surface 26 of the counter piece 24 is at a distance or spacing 52 away from an inner contact surface 25 of the carrying member 47. Furthermore, the spacing 53 arises between the end face 54 of the bushing 31 or of the finish forming die 1 and a contact surface 55 of the stamp guide bushing 6. The raw blank 4 is then in the position as shown in FIGS. 2*a* and 2*b*, on the one hand partially in the stamp guide bushing 6 and on the other hand partially in the finish forming die 1. The material volume of the raw blank 4 has been determined by calculation or experiment so that it will completely fill the shape defining hollow space of the finish forming die 1 in order to form the finished work piece with its stem and disk or head.

In order to carry out the extrusion molding process, the actuating cylinder 13 is now driven by a pressure p2 through the lower pressure connection against the side of the piston 37 facing away from the piston rod 11, whereby the piston rod 11 is driven outward until the spacing 52 becomes zero so that the surfaces 26 and 25 contact each other. In this state, the front end face of the extrusion molding stamp 7 lies in the same plane as the front face of the annular piston 10 so that a single closed surface is formed. Furthermore, the stem region 2 and the widened stem region 3 have been completely filled by the material of the blank 4 through the above described extrusion molding process and a thickened region from which next the poppet disk or head will be shaped, has been formed in the disk region 5. In order to form the valve head, for example, the pressure p3 is now removed so that the piston rods 17 and 18 may easily be pressed in. Here, the force of the piston rods 12 and 11 or rather pistons 38 and 37 driven by the pressures p1 and p2 preponderates so that now the extrusion molding stamp 7 and annular piston 10 are driven forward together through the distance 53 until this distance becomes zero and the contact surface 55 of the stamp guide bushing 6 contacts the end face 54 of the bushing 31 or of the finish forming die 1. Therewith, the poppet valve head is completely formed by an upsetting operation following an extrusion operation.

It is not absolutely necessary that the pressure p3 is completely removed for the finish forming of the poppet valve head. It is also possible to correspondingly increase the pressures p1 and p2 so that the piston rods 18 and 17 are pressed in against the pressure p3. By means of controlling the pressure magnitude of the pressures p3, or p1 and p2, the extrusion molding velocity and the upsetting velocity may be controlled as well, not only in general, but also during the pressing process. By these means flow resistances, deformation resistances, and grain formation of the work piece material may be affected or influenced.

The forces arising during the extrusion molding process and the upsetting process are taken up by the tie rods 16 between the traverse girder 15 and the supporting frame 8. In order to achieve this, the tie rods 16 are, for example, passed through appropriate bored holes in the traverse girders 15 and the supporting frame 8 and are countered at their ends with nuts 56.

If the unit is to be returned to the initial position shown in FIG. 1, after carrying out the work process, then the pressures p1 and p2 are simply removed. The pressure p4 is always supplied through an appropriate connection and keeps the cylinders 13 and 14 filled at a corresponding pressure through the conduits 57 and 58. So, if the pressures p1 and p2 are removed, the pressure p4 preponderates so that the pistons 37 and 38 and therewith their piston rods 11 and 12 return to the initial position. Simultaneously, the fluid delivered through the pressure connections of pressure p4 may be used for removing heat from the device itself and especially from the tools. In order to achieve this, the oil exiting from the conduit 57 into the cylinder 14 may be delivered to the carrier member 47 through the conduit 59 and there guided through the carrying member 47 in an appropriate manner for achieving the necessary removal of heat. In order to prevent an excessive mass throughflow, and therewith an excessive pressure drop in the cylinder 14, a constant throttle 60 (FIGS. 2*a* and 2*b*) is placed in the conduit 59.

The pressure medium used as a cooling medium is directed through the conduit 59 through the constant throttle 60 and thereafter through the carrying member 47 for cooling and is then delivered through the conduits 61 and 62 into a recess 63 of the spacer bushing 39. However, the cooling medium may simultaneously be delivered through the conduit 62 into the free space 64 between the piston rod 12 and the piston rod 11. However, because the conduit 61, 62 is a return conduit, a significantly reduced pressure relative to the pressure p4 exists there. Therefore, the oil returned through the conduits 61 and 62 into the recess 63 is directed through a bored hole 65 in the wall of the spacer bushing 39 into an outer recess 66, and from there is returned through a conduit 67 to the outside, or rather to the tank. Here, the conduit 67 is at the pressure p5.

The pressure p4 is also delivered to the cylinder 13 through the conduit 58. For cooling the extrusion molding stamp 7, the medium delivered through the conduit 58 into the cylinder chamber 13 is pressed through a cross-bored hole 68 in the piston rod 11 into a lengthwise bored hole 69 extending along the axis of the piston rod 11. A constant throttle 70 (FIGS. 2*a* and 2*b*) is again arranged in the bored hole 69 in order to prevent an excessive pressure drop of the potential p4. Behind the constant throttle 70, the cooling medium is directed through the conduits 71 and 72, which are merely indicated by a dashed line in FIGS. 2*a* and 2*b* through the extrusion molding stamp 7 and from there returning into a conduit 73 which ends in a cross-bored hole 74 of the piston rod 11. When necessary, the cross-bored hole 74 may open into a circumferential groove 75. The conduit 73 is closed at its end opposite the cross-bored hole 74 by a conduit plug 76. The cooling medium arrives through the cross-bored hole 74 into the interspace between the piston rod 12 and the piston rod 11 and can thereby return in an already described manner through the conduit 62 and finally exit at the pressure p5.

The spacial orientation of the apparatus is preferentially as shown in FIGS. 1, 2*a* and 2*b*. Such an orientation is, however, only advantageous and not necessary. In principle, any desired spacial orientation of the apparatus may be used.

When a work piece has been completely farmed and the apparatus is again returned to the initial position shown in FIG. 1, then the ejection cylinder 28 may be actuated so that the work piece is ejected from the finish forming die 1 by means of the ejector 29. The ejection cylinder 28 with the ejector 29 can have any desired construction type.

The entire apparatus as such may, for example, be connected at the traverse girder to a stand having any desired shape so that the apparatus may be secured to a foundation or to other machines or machine groups. The means by which the entire apparatus may be attached to any other desired structural group or to a foundation is not the subject of the invention. The form thereof is as desired by any average worker skilled in the art.

FIG. 3 shows a hydraulic circuit diagram of a hydraulic arrangement by means of which the apparatus according to the invention could be driven. A three-phase alternating current motor MO drives the control pumps HP1 and HP2 which cooperate respectively with electric proportional magnets YHP1 and YHP2. The above named electric proportional magnets YHP1 and YHP2 may, for example, be controlled by a machine control, which is not shown in detail, so that the delivery capacity of the control pumps HP1 and HP2 may be controlled in a desired manner during operation. This is important in order to control the drive velocity of the working tools, which is dependent on the delivery capacity of these pumps, in a desired manner during operation, for example, in such a manner that the drive velocity becomes slower with advancing drive distance according to an exponential function. Such a control system is required, for example, in order to always maintain the upsetting advance velocity below the softening velocity of the material, and thereby to reduce the upsetting forces.

The pumps HP1 and HP2 are furthermore each respectively protected by a so-called pressure interceptor AHP1 and AHP2, and both draw hydraulic fluid from a sump tank T. All return flows are directed to the tank T.

The hydraulic system comprises two hydraulic pressure reservoirs HS1 and HS2 which determine the pressures p3 and p4 and supply the cooling circuit flow for the tools through the valves 60, 70. During the work piece exchange time, the filling state of the hydraulic reservoirs HS1 and HS2 is topped off. The hydraulic reservoir HS1 is filled in that the control valves cooperatively arranged with the appropriate pressurizing valves, are moved to the appropriate switching position. According to the circuit diagram of FIG. 3, the magnets of the cooperatively arranged control valves Y1.1 and Y1.2 must remain in the switching position shown. This is the switching position which they adapt in the powerless state. In contrast, the corresponding switching magnets Y1.0 and Y1.3 must be oppositely switched or brought into the switching state which they adapt under application of an appropriate voltage. This means, for example, that the control pressure is no longer at hand due to the switching of Y1.3 so that the cooperatively arranged valve is open for throughflow.

The hydraulic reservoir HS2 is filled through switching the magnets Y2.0 and Y2.1 while magnet Y2.2 remains in the resting position shown.

The proportional magnet YHP1 at the control pump HP1 can obtain a rated value for the filling volume from a machine control. The pressure state of the hydraulic reservoirs HS1 and HS2 is monitored by the pressure switches SP4 and SP3 respectively.

In order to carry out the necessary working motion, the control pump HP1 must operate with a certain delivery capacity. The latter is adjusted as a rated value by means of the proportional magnet YHP1. The switching magnets Y1.0 and Y1.3 are switched while the switching magnets Y1.1 and Y1.2 remain in their null positions. In this valve setting, the pump HP1 delivers oil at pressure p1 into the conduit, whereby the pressure is limited by the pressure limiting valve AHP1. Thereby, the piston rod 12 of the cylinder 14 is driven outwards and thereby carries along the piston rod 11 of the cylinder 13. Here, the pressure limiting valve AP1 is adjusted so that when the end face 51 of the piston rod 12 comes into contact with the end faces 21 and 22 respectively of the piston rods 17 and 18, the piston rods 17 and 18 respectively cannot be pressed into their cooperatively arranged cylinders 19 and 20. Thus, the force produced by the piston rods 17 and 18 together must be larger than the counter force applied by the piston rod 12. Thereby, the piston rod 12 comes to a standstill as soon as the end face 51 of the carrying member 47 contacts the end faces 21 and 22 of the piston rods 17 and 18. At this point, the position according to FIGS. 2*a* and 2*b* is achieved. Now the piston rod 11 is driven further. To achieve this, an appropriate rated value for setting the delivery capacity of the pump HP2 is delivered to the proportional magnet YHP2 and the switching magnet Y2.0 and Y2.2 is switched while Y2.1 remains in the rest position. When the spacing 52 has been traversed so that the inner stop surface 25 rests against the counter surface 26, a switching reversal results. Then, the control magnets Y1.1 and Y1.2 are switched into the active position. This is the position other than the one shown in FIG. 3. Through this, the piston rods 12 and 11 are driven further outwards with a velocity which is dependent upon the delivery capacity of the pumps HP1 and HP2. This delivery capacity is controlled in a desired manner by a machine control, which is not shown, by means of the proportional magnets YHP1 and YHP2. Thereby, the extrusion molding stamp 7 and the annular piston 10 together traverse the spacing 53 as an upsetting path distance. Thereafter, the work piece has received the desired upsetting and the entire switching circuit returns to the null position. It should be noted that during the traversal of the distance 53, the appropriate pressure interceptors limit the forces which arise.

In the apparatus described above, the piston rods 17 and 18 were used for stroke limiting. However, these outer stops could also be repositioned to the inside as shown in FIG. 4. There, the piston rods 17 and 18 with the cooperating cylinders 19 and 20 are completely eliminated. Instead, a free space 79 is provided for the spacer bushing 39.1 so that the latter may carry out a corresponding stroke within the free space. The pressure p3 is directed into the cylinder chamber of the actuating cylinder 14 on the side of a stroke stop 77 and pushes the spacer bushing 39.1 against an inner stop 78. In this position the former forms a first stop 80 for a piston surface 81 of the piston 38. If pressure p3 is removed, then the piston 38 can move the spacer bushing 39.1 against the stroke stop 77, whereby the end position for the piston 38 is determined by means of the length of the spacer bushing 39.1.

Although the invention has been described with reference to specific example embodiments, it will be appreciated, that it is intended to cover all modifications and equivalents within the scope of the appended claims.

What is claimed is:

1. A method of manufacturing a poppet valve member having a stem portion and a poppet disk, comprising the following sequence of steps:

(a) using a single finish forming die means of hard metal having a first stem forming cavity, a second widened stem forming cavity, and a third poppet disk forming cavity, (b) heating and cutting to length a work piece blank, then (c) first extrusion pressing and simultaneously guiding said heated and cut blank in such a way that said first and second stem cavities must be filled to form said stem portion prior to any filling of said poppet disk cavity, and then immediately in the same finish forming die means, (d) upset pressing without any further extrusion said heated and extrusion pressed blank for only now filling said third poppet disk cavity, whereby said stem portion is formed first by extrusion pressing and said poppet disk is formed next by upset pressing and all three cavities of said finish forming die means are filled in one uninterrupted operation in a single work cycle and in the same work station to avoid repositioning of said work piece blank.

2. The method of claim 1, further comprising controlling the upsetting velocity during said upset pressing step in such a manner that said upsetting velocity always remains below the softening velocity of said blank.

3. A method of manufacturing a poppet valve head, comprising the following steps:

(a) using a single finish forming die means of hard metal having a first stem cavity, a second widened stem cavity, and a third poppet disk cavity, (b) heating and cutting to length a work piece blank, (c) first extrusion pressing said heated and cut blank for filling said first and second stem cavities, and then immediately in the same finish forming die means, (d) upset pressing without any further extrusion said heated and extrusion pressed blank for filling said third poppet disk cavity and controlling the upsetting velocity during said upset pressing step in such a manner that said upsetting velocity always remains below the softening velocity of said blank, whereby all three cavities of said single finish forming die means are filled in one uninterrupted operation.

4. The method of claim 3, further comprising guiding said blank during said extrusion pressing.

* * * * *